US008624143B2

(12) United States Patent
Bonetti et al.

(10) Patent No.: US 8,624,143 B2
(45) Date of Patent: Jan. 7, 2014

(54) MOVING ELEMENT FOR A LOW VOLTAGE SWITCHING DEVICE AND SWITCHING DEVICE COMPRISING THIS MOVING ELEMENT

(75) Inventors: Luigi Bonetti, Bergamo (IT); Michele Ferrari, Bergamo (IT)

(73) Assignee: ABB S.p.A., Milan (IT)

( * ) Notice: Subject to any disclaimer, the term of this patent is extended or adjusted under 35 U.S.C. 154(b) by 228 days.

(21) Appl. No.: 13/142,753

(22) PCT Filed: Dec. 29, 2009

(86) PCT No.: PCT/EP2009/068005

§ 371 (c)(1),
(2), (4) Date: Jun. 29, 2011

(87) PCT Pub. No.: WO2010/079109

PCT Pub. Date: Jul. 15, 2010

(65) Prior Publication Data

US 2011/0266126 A1 Nov. 3, 2011

(30) Foreign Application Priority Data

Jan. 8, 2009 (IT) ..... MI2009A0012

(51) Int. Cl.

| | |
|---|---|
| ***H01H 3/08*** | (2006.01) |
| ***H01H 19/00*** | (2006.01) |
| ***H01H 19/14*** | (2006.01) |
| ***H01H 21/00*** | (2006.01) |

(52) U.S. Cl.
USPC ..... 200/336

(58) Field of Classification Search
USPC ..... 200/336, 329, 335, 332, 5 R, 5 B, 6 R, 200/6 A, 8 A, 6 BA, 19.06, 19.07, 19.18, 200/19.2, 19.22, 19.27, 49, 51.04, 400, 410, 200/416, 470, 273, 320
See application file for complete search history.

(56) References Cited

U.S. PATENT DOCUMENTS

| | | | | |
|---|---|---|---|---|
| 4,644,120 | A | 2/1987 | Tedesco | |
| 5,539,167 | A * | 7/1996 | Hood et al. | 200/244 |

(Continued)

FOREIGN PATENT DOCUMENTS

| | | | |
|---|---|---|---|
| CN | 1483213 | A | 3/2004 |
| CN | 101176179 | A | 5/2008 |
| WO | WO-9522165 | A1 | 8/1995 |

OTHER PUBLICATIONS

Chinese Office Action dated May 6, 2013.

*Primary Examiner* — Edwin A. Leon
*Assistant Examiner* — Anthony R. Jimenez
(74) *Attorney, Agent, or Firm* — Novak Druce Connolly Bove + Quigg LLP

(57) ABSTRACT

A moving element for a low voltage switching device is provided. The moving element comprises a shaped body provided for each pole, a housing unit housing at least one electrical contact, and an actuating connecting rod provided with a pair of lateral portions connected by a transverse portion. The actuating connecting rod is connected to the shaped body through pin connection means comprising a first and a second pin shaped portion, emerging from one side of a corresponding lateral portion. The shaped body comprises a pair of seats, each to house a corresponding pin shaped portion so as to define a rotation axis for the connecting rod with respect to the shaped body. The first lateral portion and the second lateral portion of the connecting rod respectively comprise a first and a second mating surface.

20 Claims, 11 Drawing Sheets

(56) References Cited

U.S. PATENT DOCUMENTS 6,194,983 B1 * 2/2001 Bogdon et al. ..... 335/68
7,358,455 B2 * 4/2008 Schaltenbrand et al. ..... 200/401
7,750,259 B2 * 7/2010 Besana et al. ..... 200/244
2004/0065531 A1 * 4/2004 Richter ..... 200/15
2004/0149555 A1 * 8/2004 Jordan ..... 200/400

* cited by examiner

MOVING ELEMENT FOR A LOW VOLTAGE SWITCHING DEVICE AND SWITCHING DEVICE COMPRISING THIS MOVING ELEMENT

CROSS REFERENCE TO RELATED APPLICATIONS

This application is a National Phase filing under 35 U.S.C. §371 of PCT/EP2009/068005 filed on Dec. 29, 2009; and this application claims priority to Application No. MI2009A000012 filed in Italy on Jan. 8, 2009 under 35 U.S.C. §119; the entire contents of all are hereby incorporated by reference.

The present invention relates to a moving element for a low voltage switching device and to a switching device comprising this moving element.

It is known that low voltage switching devices (i.e. for applications with operating voltages up to 1000V AC/1500V DC), such as automatic circuit-breakers, disconnectors and contactors, universally called switching devices and subsequently called switches for the sake of brevity are devices conceived to permit correct operation of specific parts of electrical systems and of the loads installed. For example, automatic circuit-breakers ensure that the rated current required can flow towards the various utilities, allowing correct connection and disconnection of the loads from the circuit and automatic sectioning of the circuit protected with respect to the electrical power source.

Prior art switches also comprise an actuating mechanism which causes the relative movement of pairs of contacts so that they can assume at least a first coupling position (switch closed) and at least a separated position (switch open). In a large number of prior art solutions the action of the actuating mechanism on the moving contacts is conventionally performed through a moving element from which the moving contacts directly protend.

Operating connection between the actuating mechanism and the moving element conventionally takes place by means of a kinematic chain; this kinematic chain is normally composed of a plurality of elements, at least one of which is connected to the moving element so as to drive it in rotation, for example in the case of manual opening of the switch, or so as to be affected by its rotation, for example in the case of the switch tripping.

In the most recent solutions, the actuating mechanism is connected to the moving element through an actuating connecting rod. More precisely, this connecting rod comprises a pair of connection portions connected transversely by a further portion. This latter is connected to the actuating mechanism of the switch while the two lateral portions are connected to the moving element through pin connection means which configure a mutual rotation axis between the connecting rod and the moving element.

In a first widely used construction type these connection means are composed of a pin which physically defines the mutual rotation axis between the connecting rod and the moving element. In a second construction type the connection means are instead defined by a pair of pin ends, each of which defined on one side by one of the lateral portions. Each pin end is inserted in a corresponding housing seat defined on the moving element so as to define the mutual rotation axis.

Although being relatively effective from the functional viewpoint, conventional solutions present some obvious limits. In fact, as it is known, during the working life of the switch each of its components is subject to deterioration or wear, for example due to the considerable thermal and mechanical stresses to which the switching device is normally subjected, during switching operations or tripping due to short circuit. However, the operating efficiency of the switch depends on the perfect state of repair of all its parts.

The joining means or the pin ends which are conventionally employed to connect the actuating connecting rod to the moving element prove to be critical components in terms of duration and reliability. In particular, in prior art solutions the pin ends must withstand stresses during any operating phase of the switch.

Another limit of conventional solutions is represented by the fact that configuration of the pin connection means requires complex assembly procedures which have a negative effect on the final production costs. Naturally, this limit is also present when maintenance operations are required to restore the connection, or function of the moving element or of the actuating connecting rod.

On the basis of these considerations, the main aim of the present invention is to provide a moving element for a low voltage switching device which allows the aforesaid drawbacks to be overcome and in particular which can be produced in a simple and reliable manner through a limited number of parts which are relatively simple to assemble and install.

This aim is achieved through a moving element for a low voltage switching device according to the indications in claim 1. Further advantageous aspects of the present invention are highlighted in the dependent claims.

In the description reference will be made to a moving element for a multi-pole low voltage switching device with simple switching. Naturally, it must be understood that the principles and the technical solutions set forth within the scope of the description of the inventive concept are also valid for other applications such as a single-pole moving element or moving elements destined for double break switching devices.

Further characteristics and advantages will be more apparent from the description of a preferred but non-exclusive embodiment of the moving element according to the present invention, illustrated by way of non-limiting example in the accompanying drawings, in which.

Figure 1:
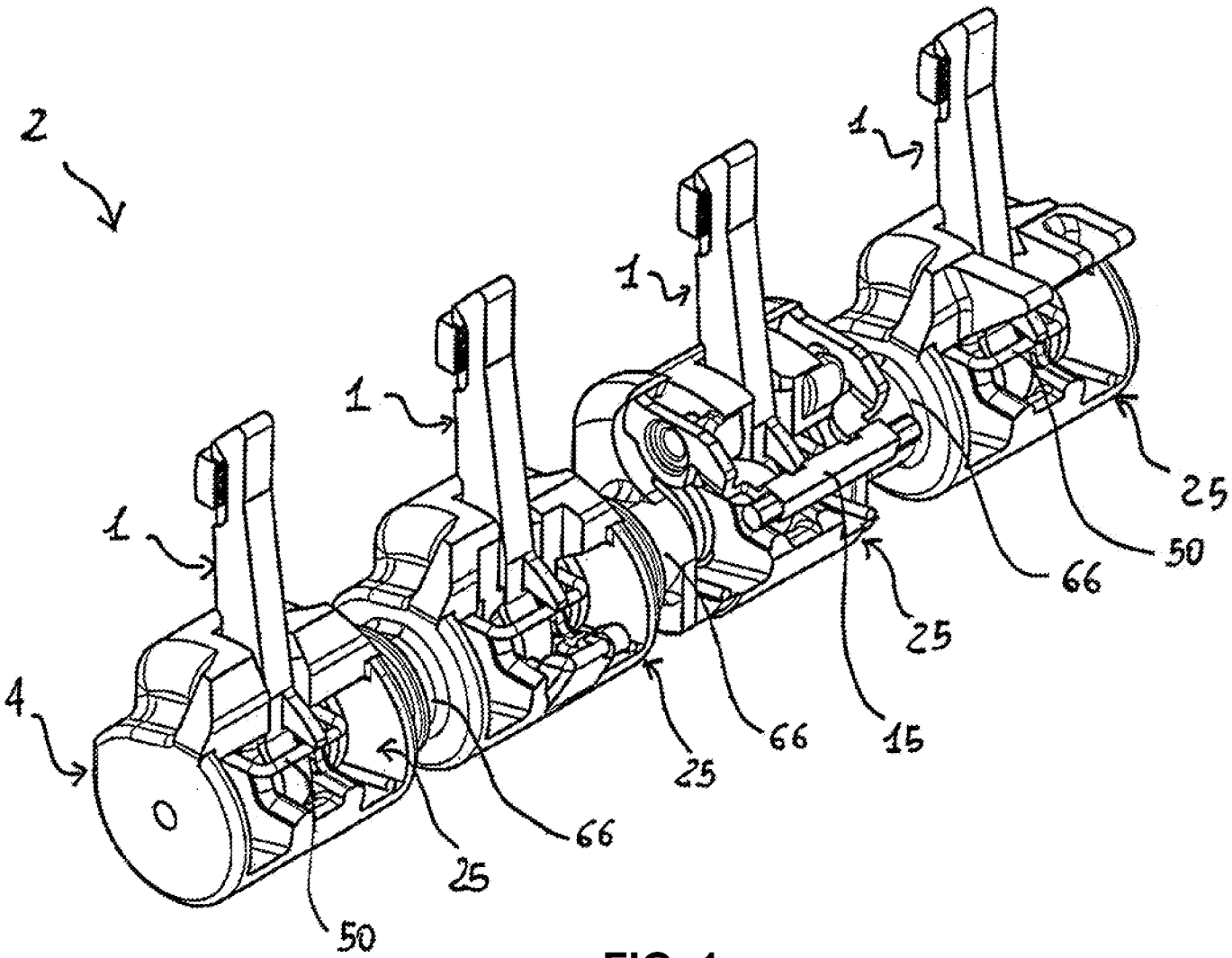
FIG. 1 is a perspective view relative to a moving element according to the present invention.

FIG. 1 is a view relative to a first embodiment of a moving element according to the present invention, indicated as a whole by the reference number 2. The moving element 2 comprises a shaped body 4 having a plurality of housing units 25 each of which housing an electrical contact 1 and at least one elastic element 50 which interacts with the electrical contact 1 to maintain it in a pre-established position with respect to the relative housing unit 25, and to adjust the contact pressure. At the same time, the elastic element 50 has the function of opposing the electrical repulsive force to which the electrical contact 1 can be subjected, in substance stabilizing this contact.

Figure 5:
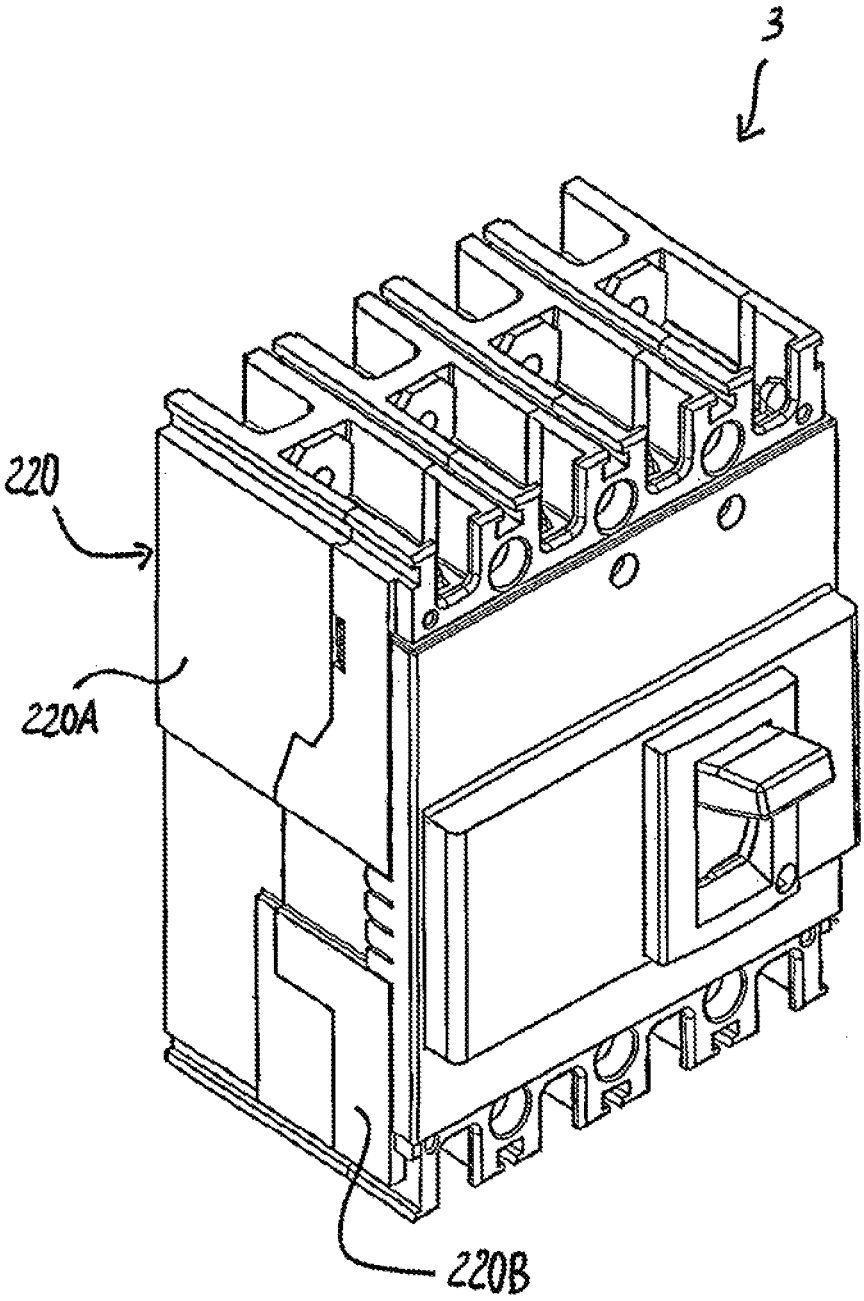
FIG. 5 is a perspective view of a switching device comprising a moving element according to the present invention.
Figure 6:
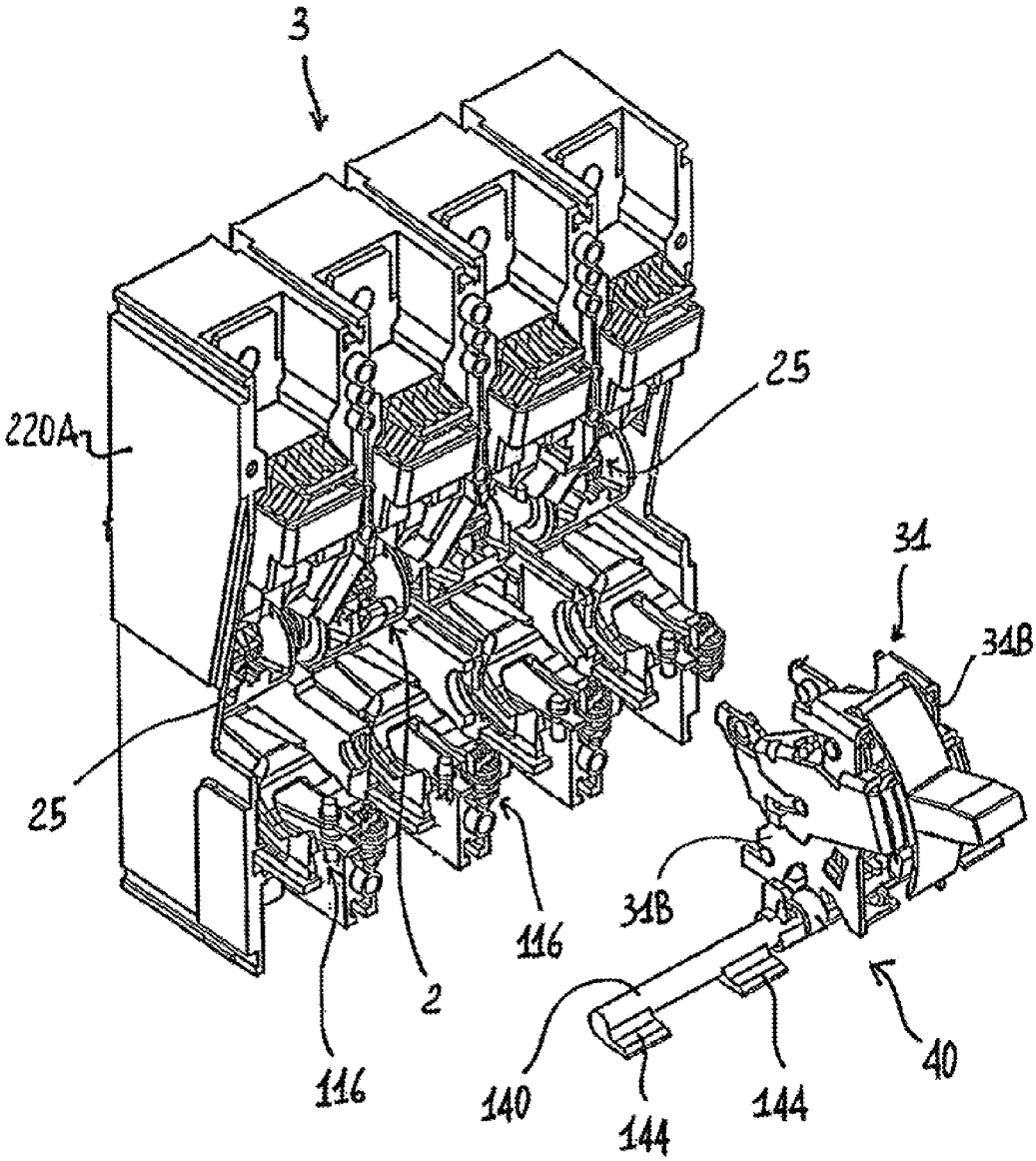
FIG. 6 is an exploded view of a switching device of FIG. 5 comprising a moving element according to the present invention.

The moving element 2 shown in FIG. 1 is intended for a single-pole or multi-pole switching device, for example with four poles as shown in FIGS. 5 and 6. In the example shown the shaped body 4 comprises four housing units, each of which houses an elastic element 50 and a relative electrical contact 1. As shown, these housing units 25 are in substance adjacent portions of the shaped body 4 mutually separated by intermediate portions 66. These latter can be geometrically coupled with relative support portions configured in the case 220 of a switching device 3 intended to receive the moving element 2. More precisely, the intermediate portions 66 are configured so that once coupled with the corresponding support portions they define a rotation axis 200 for the shaped body 4.

The moving element 2 also comprises an actuating connecting rod 15 susceptible to be operatively connected to an actuating mechanism 40 of the switching device 3 intended to receive the moving element 2. The actuating connecting rod 15 comprises a pair of mutually opposite lateral portions 41A, 41B which are connected by a transverse connection portion 42 (see FIG. 2). The actuating connecting rod 15 is connected to the shaped body 4 through pin connection means. These latter comprise a first pin shaped portion 71 which emerges from a first lateral portion 41A and a second pin shaped portion 72 which emerges from a second 41B of said lateral portions.

The transverse connection portion is susceptible to be connected to an operating element of the actuating mechanism 40. More precisely, in the case shown the transverse connection portion 42 comprises a central segment 42A at the end of which two pin ends 42B are defined. As described in greater detail below, the central segment 42A is susceptible to be connected with one or more control springs 37 of the actuating mechanism 40, while the two pin ends 42B are intended to be placed inside relative housing seats defined on an operating element (indicated below with fork 33) of the actuating mechanism 40.

Figure 4:
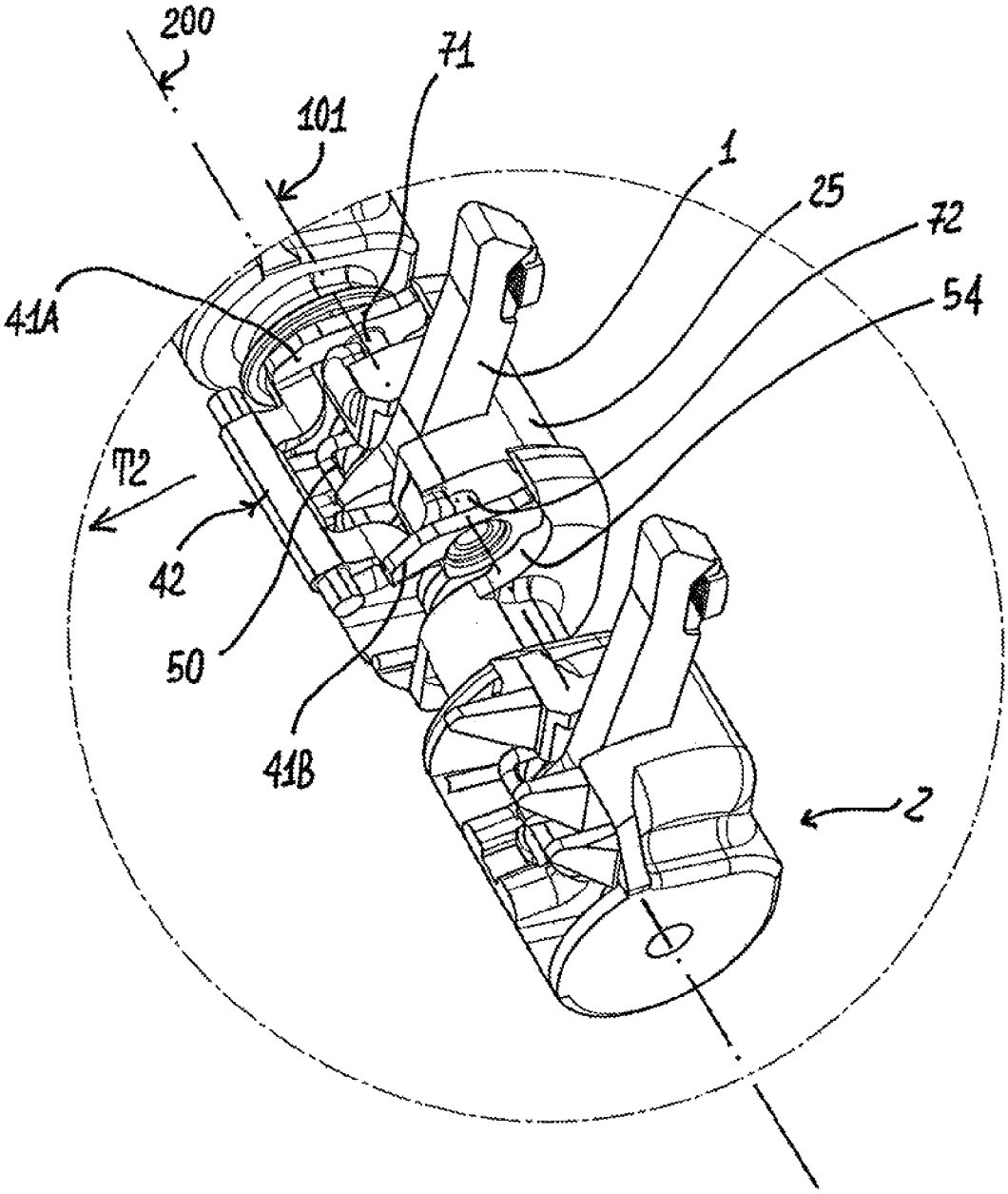

The shaped body 4 comprises a first 9A and a second seat 9B in which the first 71 and the second 72 pin shaped portion are respectively inserted so as to define a mutual rotation axis 101 of the connecting rod 15 with respect to the shaped body 4 (see FIG. 4). This mutual rotation axis 101 is defined so as to be substantially parallel to the rotation axis 200 about which the shaped body 4 is free to rotate once the moving element 2 is inserted in a switching device 3.

The first lateral portion 41A of the connecting rod 15 comprises a first mating surface 51 defined in a position opposite the transverse portion 42 with respect to the first pin shaped portion 71. Similarly, the second lateral portion 41B of the connecting rod 15 comprises a second mating surface 52, also opposite the transverse portion 42 with respect to the second pin shaped portion 72. The shaped body 4 also comprises a third mating surface 53 and a fourth mating surface 54 susceptible to respectively contact the first 51 and the second mating surface 52 when the pin shape portions 71, 72 are inserted in the corresponding seats 9A, 9B.

Figure 2:
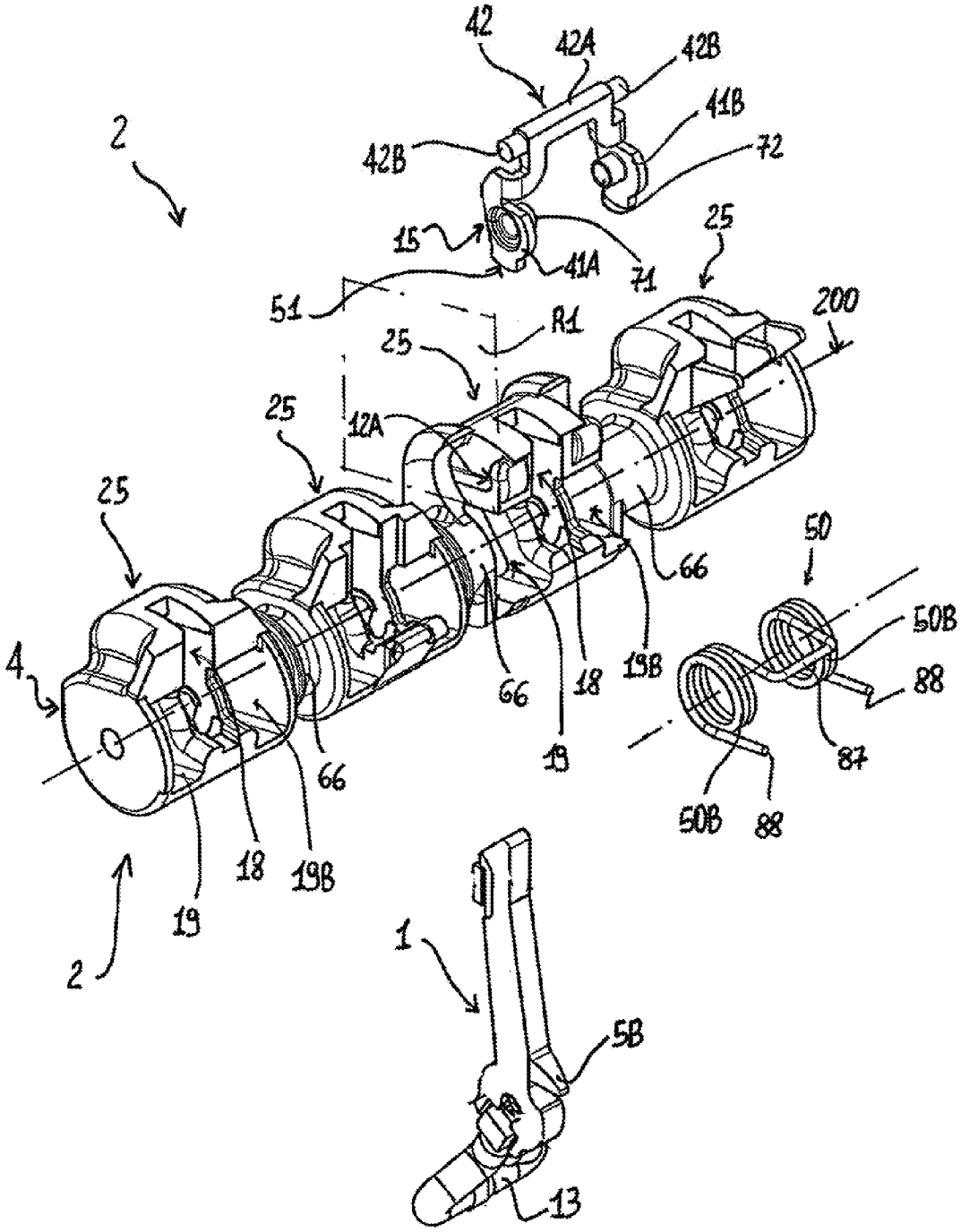
FIG. 2 is an exploded view relative to a group of components of the moving element of FIG. 1.
Figure 3:
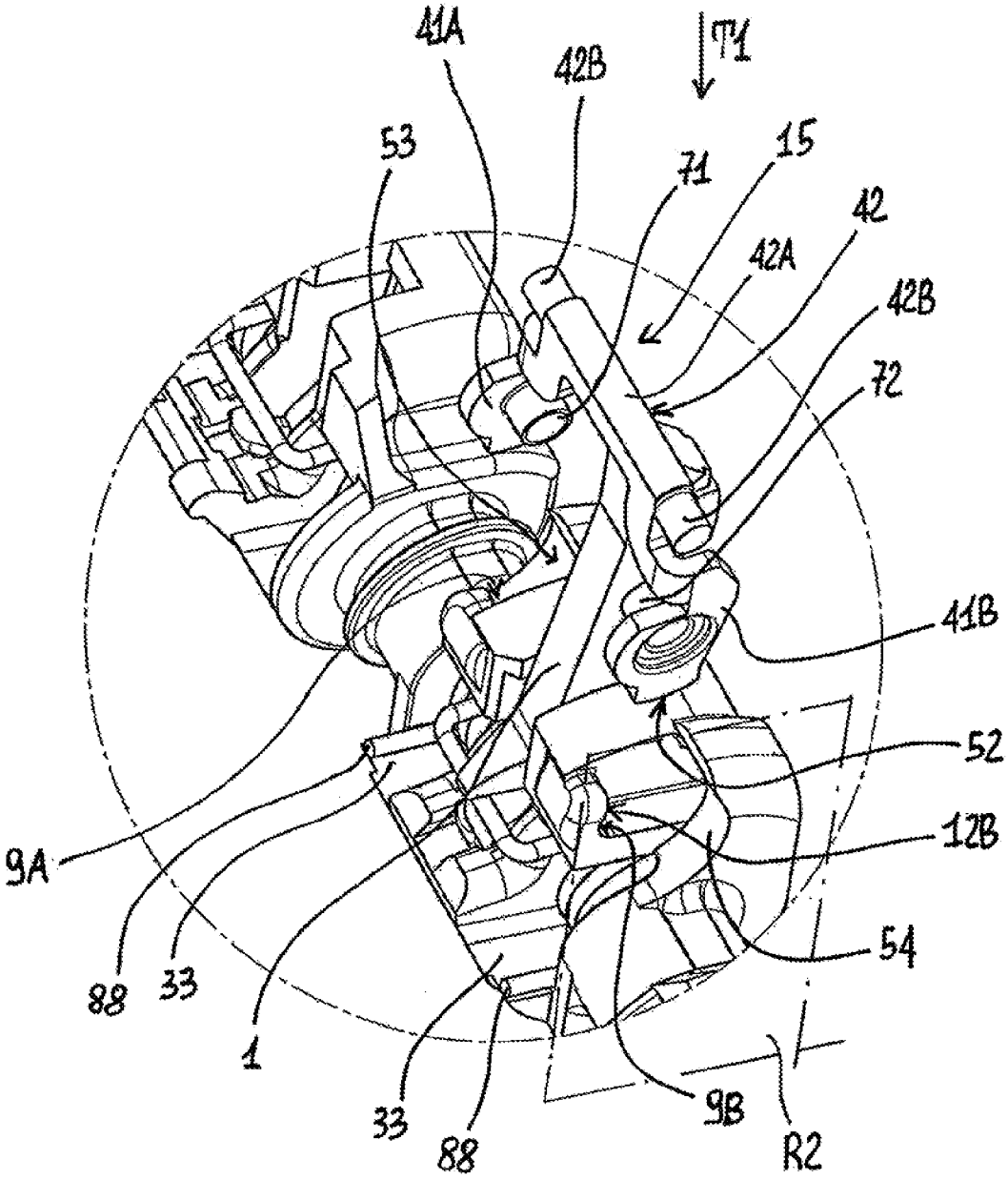
FIGS. 3 and 4 are detailed views relative to the moving element shown in FIGS. 1 and 2.

FIG. 2 shows the shaped body 4 and the actuating connecting rod 15 mutually separated. As shown in FIG. 3, the first 9A and the second seat 9B are both defined by shaped portions of a same housing unit 25. Through this solution the actuating connecting rod 15 is directly connected to only one of the housing units 25 of the shaped body 4. More precisely, the actuating connecting rod 15 determines rotation of the shaped body 4 when the configuration of the actuating mechanism 40 connected thereto is subjected to a variation. This variation can be the consequence of a controlled action (opening or closing) imparted on the mechanism or can be the consequence of a tripping of the actuating mechanism determined by a short circuit of the switching device 3.

As indicated in FIG. 2, the housing unit 25 to which the actuating connecting rod 15 is connected comprises a main cavity 18 from which the electrical contact 1 emerges. The housing unit 25 also comprises a first lateral cavity 19 and a second lateral cavity 19B in which elastic portions 50B of an elastic element 50 are housed. More precisely, the two lateral cavities 19 and 19B are defined in symmetrical position with respect to the main cavity 18 and each comprises an opposing surface 33 for a free end 88 of one of said elastic portions 50B.

The two seats 9A and 9B, in which the pin shaped portions 71, 72 of the connecting rod 15 are housed, are placed in substantially symmetrical position with respect to the central cavity 18 and each in a position substantially above one of the lateral cavities 19, 19B. This position above corresponds to a position substantially opposite with respect to the opposing surface 33 on which the free ends of the elastic element 50 rest.

FIG. 3 is a first detailed view showing the actuating connecting rod 15 separate from the moving element 2, or in a condition prior to assembly thereof. According to a preferred embodiment of the invention, the third 53 and the fourth mating surface 54 of the moving element 2 are curved surfaces which are substantially coaxial to the support surfaces 12A, 12B respectively of the first 9A and of the second rotation seat 9B. This means that the third mating surface 51 and the first seat 9A have centers of curvature lying on an axis of reference on which the centers of curvature of the fourth mating surface 54 and of the second seat 9B also lie. Once the actuating connecting rod 15 is connected to the shaped body 4 (condition shown in FIG. 4), this reference axis substantially coincides with the mutual rotation axis 101 indicated above.

Again according to a preferred embodiment of the invention, the first mating surface 51 and the second mating surface 52 are curved surfaces whose curvature is geometrically matched respectively with the curvature of the third mating surface 53 and of the fourth mating surface 54. This means that according to this solution contact between the first surface 51 and the third surface 53 and contact between the second surface 52 and the fourth surface 54 extends along several points, offering an improved distribution of forces between the fixed surfaces.

With reference again to the view in FIG. 3, the curvature of the surface 12A, 12B of each seat 9A, 9B is substantially opposite the curvature of the corresponding mating surface 53, 54 produced on the same side of the housing unit 25 and considered with respect to the main cavity 18 of this unit. It can also be observed that the first seat 9A and the third mating surface 53 are defined on opposite semi-planes of a first reference plane R1 substantially orthogonal to the mutual rotation axis 101. Similarly, the second seat 9B and the fourth mating surface 54 lie on opposite semi-planes of a second reference plane Rs also substantially orthogonal to the mutual rotation axis 101 and substantially parallel to the first reference plane R1.

The position of the seats 9A, 9B with respect to the third 53 and fourth mating surface 54 is defined so as to allow insertion of the pin shaped portions 71, 72 in these seats 9A, 9B according to a substantially pre-established insertion operation. This characteristic can be observed by comparing FIG. 3 and FIG. 4. It is observed that the actuating connecting rod 15 is inserted according to a direction of insertion (arrow T1 in FIG. 3) substantially perpendicular to the direction of use (arrow T2 in FIG. 4), or to the direction assumed by the connecting rod 15 during normal operation of the switching device 3. When the actuating connecting rod 15 is oriented as shown in FIG. 4, the pin shaped portions 71, 72 are maintained stably in their operating position as a result of the constraints created by the pairs of surfaces (51-53 and 52-54) mutually in contact at the rotation seats 9A,9B. Ultimately, this special configuration breaks down the reciprocal action of the connecting rod 15 towards the shaped body 4 into two different areas, or two distinct areas of the connecting rod and two distinct areas of the shaped body 4. More precisely, the pin portions 71, 72 act on the corresponding seats 9A, 9B while the first 51 and the second mating surface 52 act respectively on the third 53 and on the fourth mating surface 54. This solution in practice allows the tensile and compressive stresses on the connecting rod 15 to be released on specifically defined and dimensioned areas of the shaped body 4 producing the technical advantage of a noteworthy increase in the useful life of the connecting rod 15, thus of the moving element 2 and consequently of the relative switching device.

The present invention also relates to a switching device 3 comprising a moving element 2 according to the present invention. More precisely, in the case shown the switching device 3 is represented by a single break multi-pole switch for a low voltage system. Naturally, it must be understood that the principles and the technical solutions set forth within the scope of the description of the inventive concept are also valid for other types of devices such as double break switching devices and/or with a different number of poles.

In the case shown in FIG. 5, the switching device 3 (hereinafter also indicated with the expression switch 3) comprises an outer case 220 containing for each pole at least one fixed electrical contact 300 and at least one moving contact 1, which can be coupled with and decoupled from each other. The outer case 220 is composed of a box 220A to which a cover 220B is connected. The box 220A and the cover 220B are structured internally so as to define support portions shaped to support corresponding intermediate portions 66 of the shaped body 4, or so as to define the rotation axis 200 of this body.

FIG. 6 is an exploded view of the switching device 3 in which the moving element 2 is shown in its operating position. As is apparent, the switch 3 comprises an actuating mechanism 40 which is operatively connected to the actuating connecting rod 15 of the moving element 2. In the case shown the actuating mechanism 40 comprises a support frame 31 which supports a kinematic chain formed by a plurality of operating elements. The support frame 31 presents a structure provided with a first pair of opposed sides 31B and mutually connected by a first transverse portion 31A.

Again with reference to FIG. 6, the switch also comprises a protective device which comprises for each pole a protective unit 116; the protective units 116 interact with a release shaft 140 which activates the actuating mechanism 40 in the case in which an operating fault is detected (i.e. a short circuit). In the case shown, the sides 31B of the support frame 31 are pivotally connected to the release shaft 140. This latter comprises activation portions 144 which interact with the protective units 116 so as to cause rotation of the release shaft 140, or tripping of the actuating mechanism 40 according to methods described below.

Figure 7:
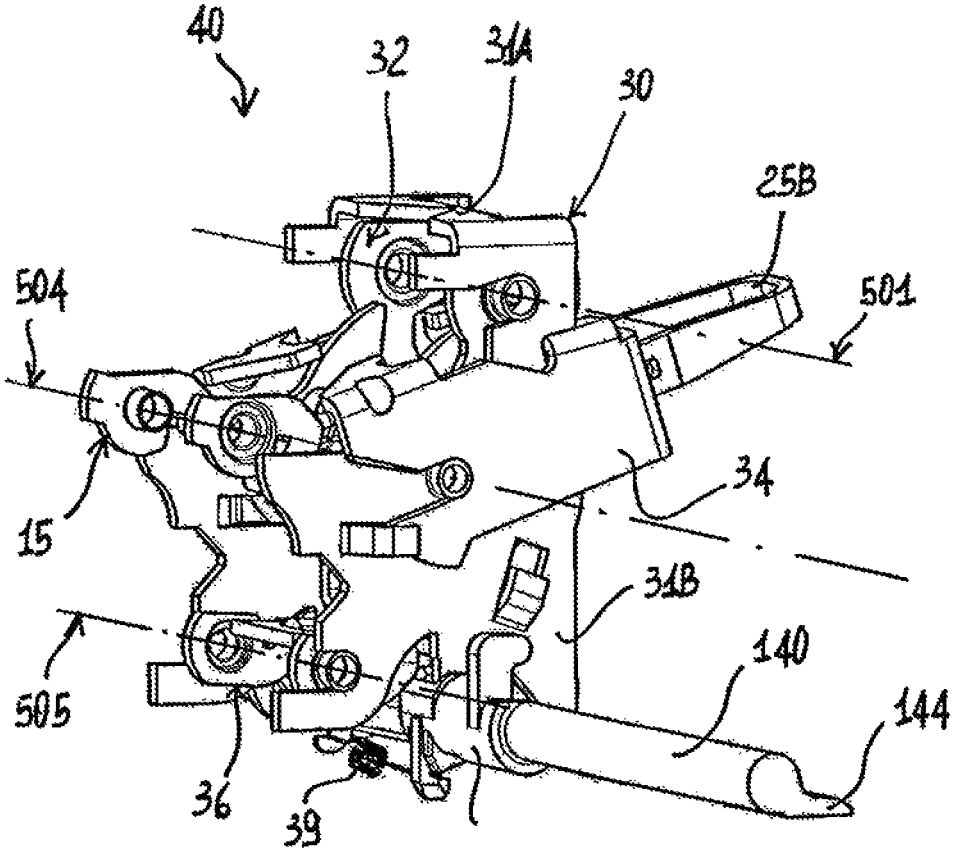
FIG. 7 is a perspective view of an actuating mechanism of the switching device of FIG. 5.
Figure 8:
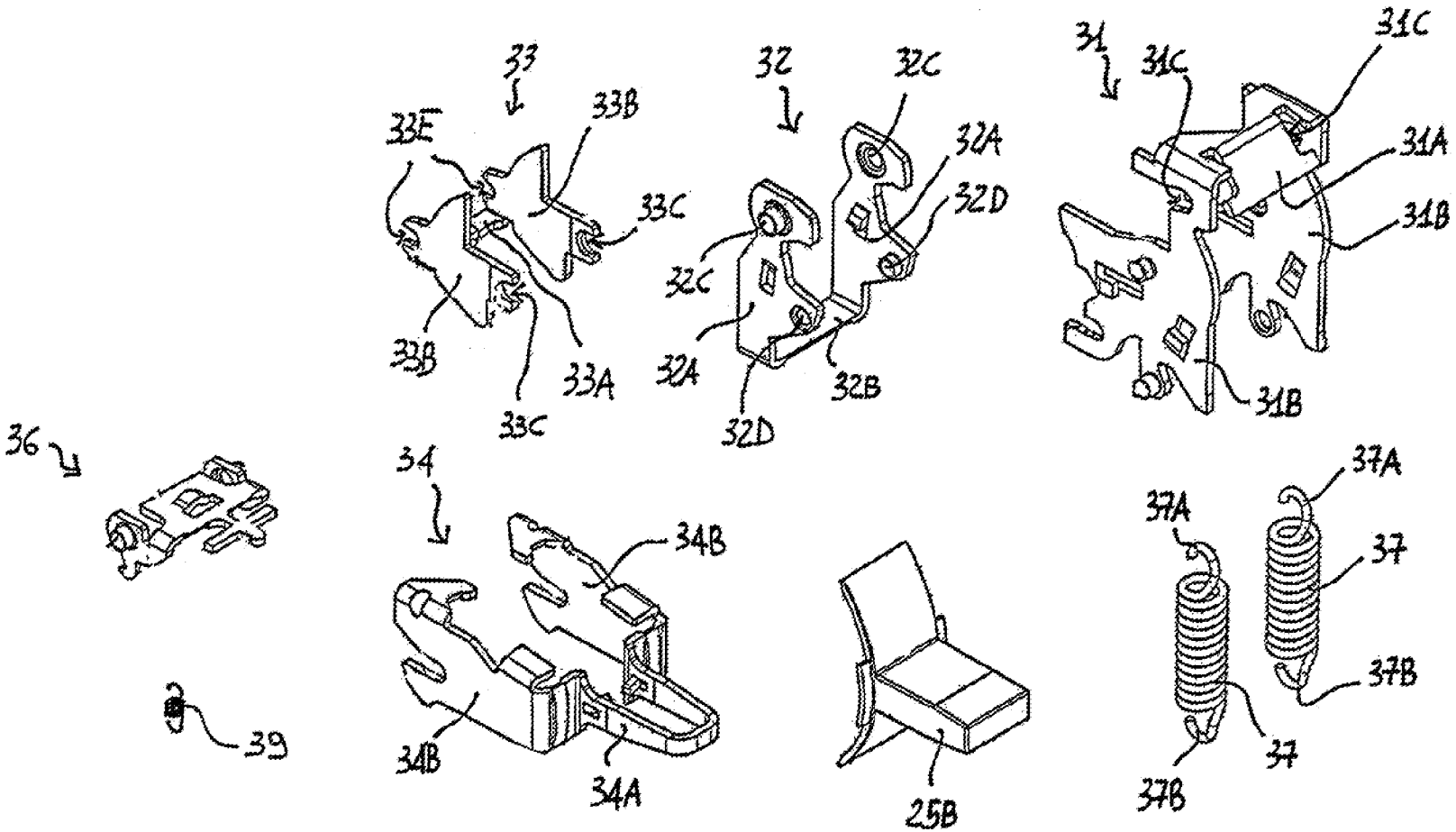
FIG. 8 is a view relative to the components of the actuating mechanism of FIG. 7.

FIG. 7 shows a perspective view relative to the actuating mechanism 40 of the switch 3 once assembled, or ready to be connected to the moving element 2. FIG. 8 instead shows the components of the actuating mechanism 40 before being assembled. The actuating mechanism 40 is set on the support frame 31 so as to be pivotal with respect thereto about a first axis 501. The structure of the main coupling 32 is substantially similar to that of the frame 31 comprising a second pair of lateral flanks 32A connected by a second transverse portion 32B. The main coupling 32 is pivoted at the flanks 31B of the support frame 31 through first pin connection means preferably composed of a pair of pin portions 32C integral with the flanks 32A of the coupling 32 and inserted in relative seats 31C defined on the flanks 31B of the frame 31.

Figure 9:
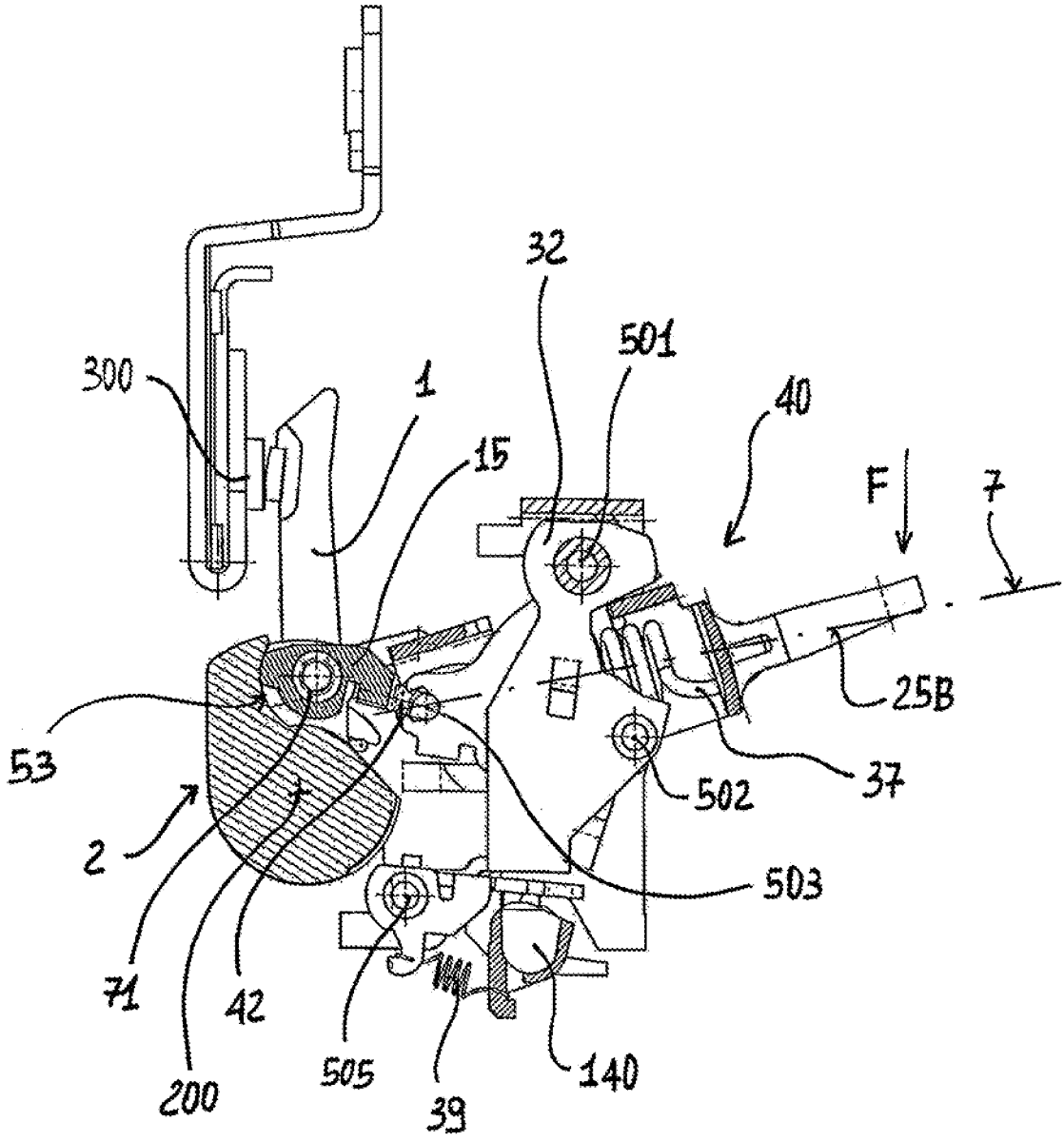
FIG. 9 is a sectional view of the switching device of FIG. 5 in "closed" configuration.

The actuating mechanism 40 also comprises a fork 33 which is pivoted to the main coupling 32 through second pin connection means which define a second rotation axis 502 (see FIG. 9). The fork 33 comprises a third pair of flanks 33B mutually connected by a third transverse portion 33A. In detail, the second connection means preferably comprise a further pair of pin portions 32D each defined on an inner side of a flank 32B of the main coupling. Each of these pin portions 32D is inserted in a relative housing seat 33C defined at a first end of a flank 33B of the fork 33. In other words, the fork 33 is pivoted to the main coupling 32 so that its flanks 33B move between the flanks 32B of the main coupling 32.

Each flank of the fork 33 also presents a second housing seat 33E defined at a second end substantially opposite the first. The pin ends 42B of the transverse connection portion 42 of the actuating connecting rod 15 of the moving element 2 are inserted in each of these seats 33E. In other words, the fork 33 represents an operating element of the actuating mechanism 40 which is directly connected to the actuating connecting rod 15. Coupling between the pin end 42B of the actuating connecting rod 15 and the relative housing seats 33E of the fork 33 define a third rotation axis 503 which allows a relative rotation between the two components (see FIGS. 9 to 11).

Again with reference to FIG. 8, the actuating mechanism 40 also comprises a lever holding element 34 which presents a C-shaped structure and which is preferably pivoted on the outer side of the support frame 31. The lever holding element 34 can be activated directly by an operator through a control lever 25B. The lever holding element 34 comprises a fourth pair of flanks 34B connected by a transverse portion 34A configured to support the control lever 25B. The flanks 34B of the lever holding element 34 are pivoted externally to the flanks 31B of the frame 31 through fourth pin connection means which configure a fourth rotation axis 504 indicated clearly in FIG. 7.

With reference to FIG. 8, the actuating mechanism 40 also comprises a pair of springs 37 which are connected at a first end 37A to the transverse portion 34A of the control lever 34 and at a second end 37B to the central segment 42A of the transverse portion 42B of the actuating connecting rod 15. The actuating mechanism 40 also comprises a release element 36 which is activated by the release shaft 140 to which the flanks 31B of the frame 31 are connected. More precisely, the release element 36 in normal operating conditions of the switching device 3 blocks rotation of the main coupling 32 with respect to the support frame 31. In the case of faults detected by the protective unit 116 of the switch 3 the release element 36 releases the main coupling 32, in practice allowing rotation according to the methods described in detail below. In the case shown, the release element 36 is pivoted at opposite ends to corresponding flanks 31B of the frame 31 so as to define a fifth rotation axis 505. The release element 36 is operatively connected to the release shaft 140 through an elastic connection element 39 as shown in FIGS. 7 and 8.

FIG. 9 is a sectional view of the actuating mechanism 40 of the switch 3 which shows it in a closed configuration in which the moving contacts 1 are coupled with the relative fixed contacts 300. In this configuration the control springs 37 are in a condition of tension and exert an elastic force which extends along a line of action 7. This line 7 is in practice defined by the points in which the control springs 37 respectively couple with the actuating connecting rod 15 and with the lever holding element 34. The release element 36 is in the coupling position to retain the main coupling 32, or to prevent rotation thereof about the first axis 501.

Figure 10:
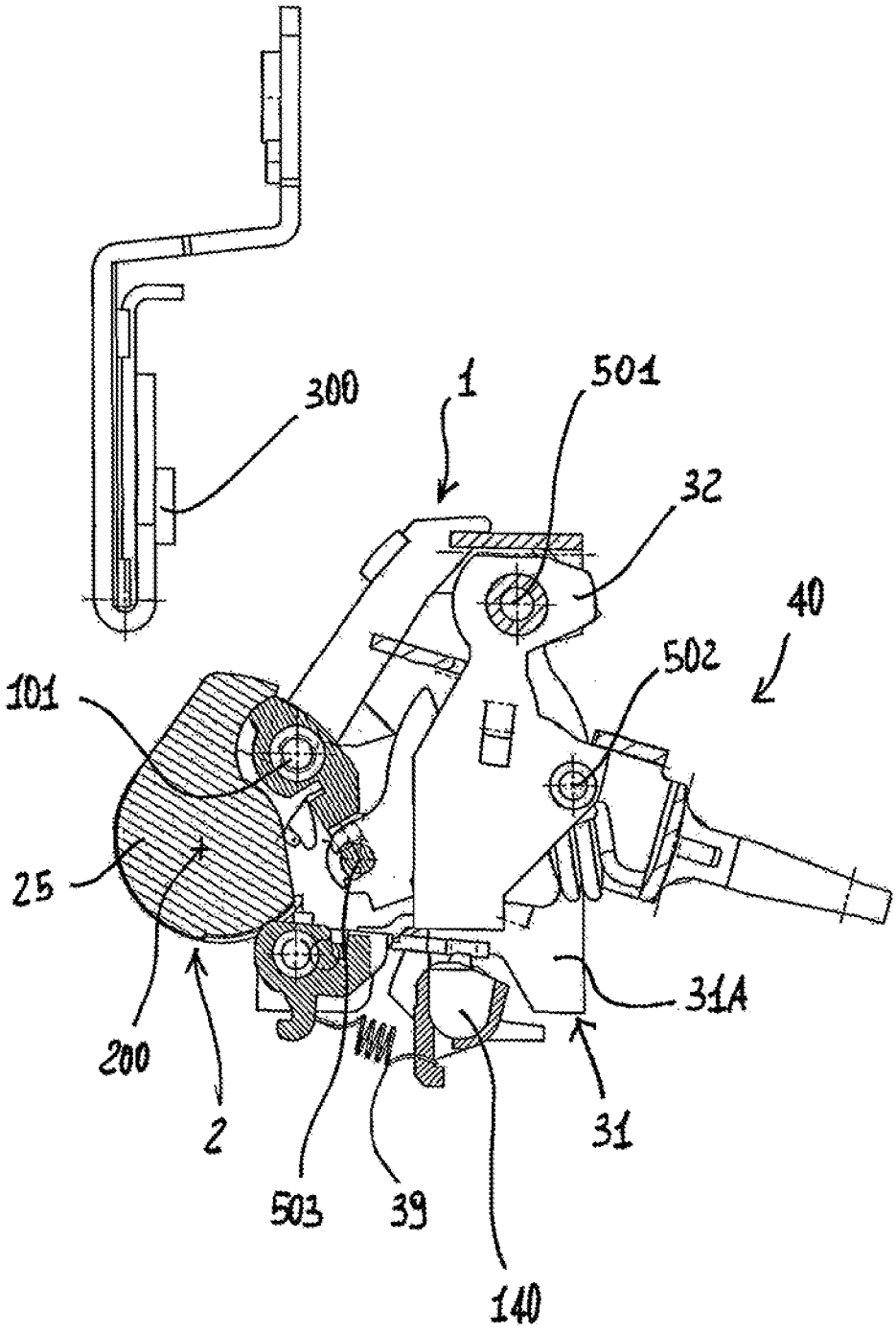
FIG. 10 is a sectional view of the switching device of FIG. 5 in "open" configuration.

Passage from the closed configuration of FIG. 9 to the open configuration (shown in FIG. 10) is implemented following operation of the control lever 25B (indicated with the arrow F in FIG. 10). This action F causes rotation of the lever holding element 34 about the fourth mutual rotation axis 504 (see FIG. 7). During a first rotation phase of the lever holding element 35, the moving contacts 1 still remain coupled while the control springs 37, connected between the lever holding element 34 and the actuating connecting rod 15, are in an increasing state of tension. This condition persists until the line of action 7 intersects the second rotation axis 502, or the mutual rotation axis of the main coupling 32 with respect to the fork 33. In this condition the control springs 37 reach their maximum extension, or its maximum state of tension. As soon as the line of action 7 is lowered, passing beyond the second rotation axis 502, the control springs 37 release the elastic energy stored during the first opening phase. This causes the actuating connecting rod 34 to be driven rapidly downward, or in the direction of the release element 36. This driving movement determines a rotation of the moving element 2 about its rotation axis 200 which results in rapid separation of the contacts 1, 300. After opening the actuating mechanism 30 reaches the configuration shown in FIG. 10. It must be observed that during opening the release element 36 maintains its coupled position.

During passage from the closed to the open configuration, the actuating connecting rod 15 is in practice driven by the fork 33 which acts at the pin end 42B of the transverse connecting portion 42. This driving of the connecting rod 15 in fact results in rotation of the shaped body 4 (clockwise) and this means that the relative stresses are released directly onto the pin portions 71, 72 of the connecting rod 15. During passage from the open to the closed configuration, the relative stresses are instead released at the mating surfaces 51, 52, 53, 54 of the connecting rod 15 and of the shaped body 4. In fact, in this case the actuating connecting rod 15 determines a counter rotation (counter-clockwise) of the shaped body 4 pushing it through the first 51 and the second mating surface 52. In other words, the configurations of the actuating connecting rod 15 and of the shaped body 4 are such as to allow improved distribution of the stresses which are released in different points of the connecting rod 15 according to the movement thereof. This obviously increases the duration and reliability of the connecting rod and consequently the reliability of the switch 3.

Figure 11:
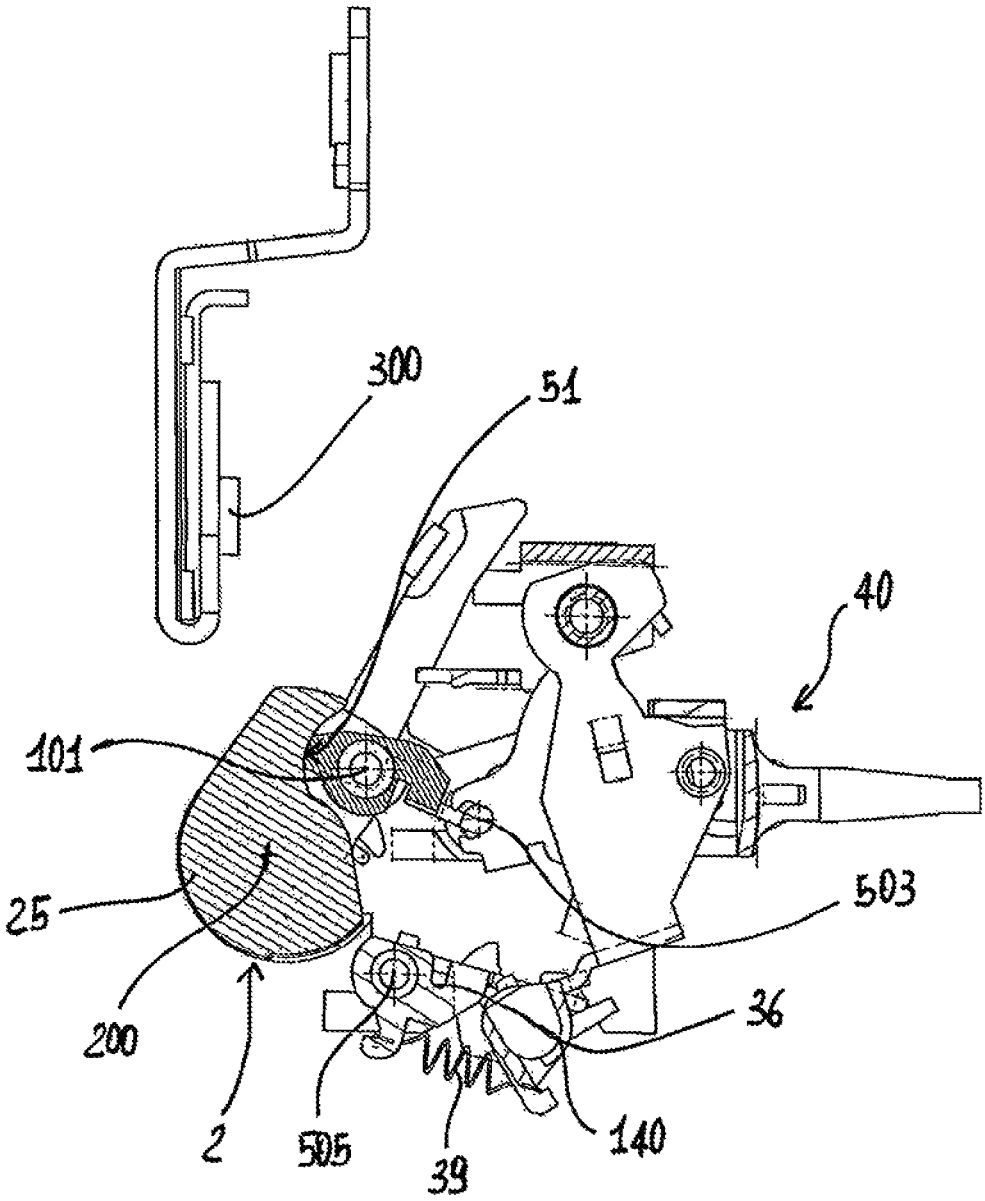
FIG. 11 is a sectional view of the switching device of FIG. 5 in "tripped" configuration.

FIG. 11 shows the actuating mechanism 40 in "tripped" configuration. Passage from the closed configuration (in FIG. 9) to the tripped configuration in fact takes place following tripping of a protective device of the switch 1 which causes a rotation of the release shaft 140. Rotation of the release shaft 140 in fact results in a rotation of the coupling element 36 about the fifth rotation axis 505 which takes it to a released position following which the main coupling 32 is free to rotate with respect to the support frame 31 about the first rotation axis 501. More precisely, when the main coupling 32 is released, the control springs 37 exert a tension on the actuating connecting rod 15 in the direction of the control lever 35B. This tension affects the main coupling 32 through the fork 33 determining rotation of this coupling 32 about the first rotation axis 501. Driving of the actuating connecting rod 15 in turn causes rotation of the moving element 2, or sudden separation of the contacts 1, 300. The actuating mechanism 40 thus assumes the configuration shown in FIG. 11, which is obviously different from that of FIG. 10 relative to manual opening.

The technical solutions adopted for the switching device according to the invention allow the aim set to be fully achieved. In particular, the presence of mating surfaces defined on the actuating connecting rod and of the shaped body 4 allows improved distribution of stresses which results in increased reliability and duration of the moving element, or of the switching device in which it is employed. It must be noted that the moving element is produced with component parts which are easy to inspect without complex maintenance procedures and which can be produced easily at limited costs.

In practice, the materials used and the contingent dimensions and forms can be any, according to requirements and to the state of the art.

The invention claimed is:

1. Moving element for a low voltage switching device, said element comprising:

a shaped body having for each pole at least one housing unit to house at least one electrical contact an actuating connecting rod, which is operatively connectable to an actuation mechanism of said switching device and which can rotationally move with respect to said shaped body, having a pair of opposed lateral portions which are connected by a transverse connection portion, said actuating connecting rod being operatively connected to said shaped body through pin connection means comprising a first pin shaped portion emerging from one side of a first of said lateral portions and a second pin shaped portion emerging from a side of a second of said lateral portions, said shaped body-comprising a first and second seats in each of which a corresponding pin shaped portion is housed, so as to define a rotation axis for said connecting rod with respect to said shaped body, which is parallel to a rotation axis of said shaped body;

wherein said first lateral portion of said connecting rod comprises a first mating surface defined in a position opposite said transverse connection portion with respect to said first pin shaped portion, said second lateral portion comprising a second mating surface defined in a position opposite said transverse connection portion with respect to said second pin shaped portion, said shaped body comprising a third mating surface and a fourth mating surface which respectively contact said first and said second mating surface.

2. Moving element as claimed in claim 1, wherein said transverse connection portion comprises a central segment whose ends define pin ends, said central segment being susceptible to be connected with one or more control springs of an actuating mechanism of said switching device, said pin ends being housed inside relative seats defined by an operating element of said actuating mechanism.

3. Moving element as claimed in claim 2, wherein said housing element comprises a main cavity and a pair of lateral cavities disposed symmetrically with respect to said main cavity, said seats for said pin shaped portions being defined in substantially symmetrical position with respect to said main cavity and each in a position above one of said lateral cavities.

4. Moving element as claimed in claim 3, wherein the first mating surface and the second mating surface are curved surfaces which are substantially coaxial to the curved support surfaces which respectively define said first and said second seat.

5. Moving element as claimed in claim 4, wherein said first mating surface and said second mating surface are curved surfaces whose curvature is geometrically matched respectively with the curvature of the third mating surface and of the fourth mating surface.

6. Moving element as claimed in claim 5, wherein said first seat and said third mating surface are defined on opposite semi-planes of a first reference plane substantially orthogonal to said rotation axis, said second seat and said fourth mating surface being defined on opposite semi-planes of a second reference plane substantially orthogonal to said rotation axis and substantially parallel to said first reference plane.

7. Single-pole or multi-pole switching device for low voltage systems comprising an outer case containing for each pole at least one fixed contact and one moving contact, said device comprising an actuating mechanism for actuation of said moving contact, characterized in that it comprises a moving element (2) as claimed in claim 1.

8. Switching device as claimed in claim 7, wherein said actuating mechanism comprises one or more control springs operatively connected to said central segment of said transverse connection portion of said actuating connecting rod.

9. Switching device as claimed in claim 8, wherein said actuating mechanism comprises a support frame to which a main coupling is pivotally connected, said mechanism comprising a fork connected pivotally to said main coupling and to said transverse connection portion of said actuating connecting rod.

10. Switching device as claimed in claim 9, wherein said fork defines a pair of housing seats in which corresponding pin ends of said transverse connection portion of said actuating connecting rod are housed.

11. Single-pole or multi-pole switching device for low voltage systems comprising an outer case containing for each pole at least one fixed contact and one moving contact, said device comprising actuating mechanism for actuation of said moving contact, characterized in that it comprises said moving element (2) as claimed in claim 2.

12. Single-pole or multi-pole switching device for low voltage systems comprising an outer case containing for each pole at least one fixed contact and one moving contact, said device comprising said actuating mechanism for actuation of said moving contact, characterized in that it comprises a moving element (2) as claimed in claim 3.

13. Single-pole or multi-pole switching device for low voltage systems comprising an outer case containing for each pole at least one fixed contact and one moving contact, said device comprising said actuating mechanism for actuation of said moving contact, characterized in that it comprises a moving element (2) as claimed in claim 4.

14. Single-pole or multi-pole switching device for low voltage systems comprising an outer case containing for each pole at least one fixed contact and one moving contact, said device comprising said actuating mechanism for actuation of said moving contact, characterized in that it comprises a moving element (2) as claimed in claim 5.

15. Single-pole or multi-pole switching device for low voltage systems comprising an outer case containing for each pole at least one fixed contact and one moving contact, said device comprising said actuating mechanism for actuation of said moving contact, characterized in that it comprises a moving element (2) as claimed in claim 6.

16. Switching device as claimed in claim 11, wherein said actuating mechanism comprises one or more control springs operatively connected to said central segment of said transverse connection portion of said actuating connecting rod.

17. Switching device as claimed in claim 12, wherein said actuating mechanism comprises one or more control springs operatively connected to said central segment of said transverse connection portion of said actuating connecting rod.

18. Switching device as claimed in claim 13, wherein said actuating mechanism comprises one or more control springs operatively connected to said central segment of said transverse connection portion of said actuating connecting rod.

19. Switching device as claimed in claim 14, wherein said actuating mechanism comprises one or more control springs operatively connected to said central segment of said transverse connection portion of said actuating connecting rod.

20. Switching device as claimed in claim 15, wherein said actuating mechanism comprises one or more control springs operatively connected to said central segment of said transverse connection portion of said actuating connecting rod.

* * * * *